US009577370B2

(12) United States Patent
Lin et al.

(10) Patent No.: US 9,577,370 B2
(45) Date of Patent: Feb. 21, 2017

(54) HIGH-SPEED CONNECTOR WITH ELECTRICAL GROUND BRIDGE

(71) Applicant: Greenconn Corp., New Taipei (TW)

(72) Inventors: Han-Nien Lin, Taichung (TW); Tung-Chi Hsieh, New Taipei (TW); Keh-Chang Cheng, New Taipei (TW)

(73) Assignee: GREENCONN CORP., New Taipei (TW)

( * ) Notice: Subject to any disclaimer, the term of this patent is extended or adjusted under 35 U.S.C. 154(b) by 0 days.

(21) Appl. No.: 14/885,700

(22) Filed: Oct. 16, 2015

(65) Prior Publication Data

US 2016/0344134 A1 Nov. 24, 2016

(30) Foreign Application Priority Data

May 22, 2015 (TW) ..... 104116453 A

(51) Int. Cl.
*H01R 12/00* (2006.01)
*H01R 13/533* (2006.01)

(52) U.S. Cl.
CPC ..... *H01R 13/533* (2013.01)

(58) Field of Classification Search
CPC ..... H01R 13/6585
USPC ..... 439/108, 189, 188
See application file for complete search history.

(56) References Cited

U.S. PATENT DOCUMENTS 3,871,728 A * 3/1975 Goodman ..... H01R 23/688 439/109
4,070,084 A * 1/1978 Hutchison ..... H01R 13/6588 333/260
4,464,003 A * 8/1984 Goodman ..... H01R 13/6593 439/404
5,035,631 A * 7/1991 Piorunneck ..... H01R 13/65802 439/108
5,061,196 A * 10/1991 Weston ..... H01R 31/08 439/189
5,431,584 A * 7/1995 Ferry ..... H01R 13/6625 333/182
5,997,348 A * 12/1999 Shepherd ..... H01R 9/032 439/579
6,067,710 A * 5/2000 Sakaoka ..... H01R 13/652 29/842

(Continued)

*Primary Examiner* — Neil Abrams
(74) *Attorney, Agent, or Firm* — Li & Cai Intellectual Property (USA) Office

(57) ABSTRACT

A high-speed electrical connector includes an insulating case, several signal terminals, several grounding terminals, an electrical bridge, and several resilient conductive buffers mounted in the insulating case. Each of the signal and grounding terminals has a fixing segment and a swing segment swingable with respect to the fixing segment. The electrical bridge corresponds to two of the grounding terminals. The conductive buffers are disposed on the electrical bridge and are respectively arranged in the swing paths of the swing segments. Each conductive buffer is configured to transform from an initial state to a deformation state by pressing. Each swing segment can swing to press the corresponding conductive buffer, causing the corresponding conductive buffer to be in the deformation state, thereby establishing an electrical connection path between the electrical bridge and the corresponding grounding terminals. In one example, the buffer can be formed of elastomer mixed with conductive particles.

17 Claims, 14 Drawing Sheets

(56) References Cited

U.S. PATENT DOCUMENTS 6,168,458 B1 * 1/2001 Kraft ..... H01R 4/2429 439/189
6,322,392 B1 * 11/2001 Wang ..... H01R 23/6873 439/101
6,361,365 B1 * 3/2002 Yu ..... H01R 13/648 439/607.22
6,733,310 B2 * 5/2004 Fujikura ..... H01R 13/2428 439/181
6,743,057 B2 * 6/2004 Davis ..... H01R 23/688 439/607.05
6,793,508 B2 * 9/2004 Chang ..... H01R 4/66 439/189
6,890,193 B2 * 5/2005 Kimura ..... H01R 13/65802 439/108
7,011,533 B2 * 3/2006 Miyamoto ..... H01R 13/65802 439/108
7,048,585 B2 * 5/2006 Milbrand, Jr. ..... H01R 23/688 439/108
7,128,611 B2 * 10/2006 Tanaka ..... H01R 31/06 439/108
7,134,912 B2 * 11/2006 Kamata ..... H01R 23/6873 439/607.31
7,320,623 B2 * 1/2008 Hisamatsu ..... H01R 12/721 439/108
7,458,829 B2 * 12/2008 Shioda ..... H01R 12/57 439/108
7,682,193 B2 * 3/2010 Stoner ..... H01R 12/727 439/607.07
8,157,596 B1 * 4/2012 Little ..... G06K 13/08 439/217
8,167,631 B2 * 5/2012 Ito ..... H01R 24/38 439/108
8,177,564 B1 * 5/2012 Ito ..... H01R 13/6471 439/108
8,221,139 B2 * 7/2012 Qin ..... H01R 13/6471 439/92
8,257,118 B2 * 9/2012 Bareel ..... H01R 13/6658 439/676
8,342,886 B2 * 1/2013 Zhang ..... H01R 12/7005 439/660
8,353,726 B2 * 1/2013 Zhang ..... H01R 12/721 439/629
8,523,583 B2 * 9/2013 Ito ..... H01R 12/721 439/108
8,545,240 B2 * 10/2013 Casher ..... H01R 29/00 439/108
8,702,451 B2 * 4/2014 Luo ..... H01R 12/725 439/607.28
8,764,460 B2 * 7/2014 Smink ..... H01R 13/6597 439/92
8,764,464 B2 * 7/2014 Buck ..... H01R 13/514 439/108
8,764,488 B2 * 7/2014 Zeng ..... H01R 13/6585 439/108
8,801,464 B2 * 8/2014 McNamara ..... H01R 13/6461 439/607.07
8,864,506 B2 * 10/2014 Little ..... H01R 13/6585 439/108
8,944,831 B2 * 2/2015 Stoner ..... 439/108
8,944,849 B1 * 2/2015 Yang ..... H01R 13/6588 439/607.07
8,944,850 B2 * 2/2015 Simmel ..... H01R 43/20 439/607.55
9,300,091 B2 * 3/2016 Katayanagi ..... H01R 24/76
9,337,585 B1 * 5/2016 Yang ..... H01R 13/6583
9,385,477 B2 * 7/2016 De Geest ..... H01R 13/6477
9,401,570 B2 * 7/2016 Phillips ..... H01R 13/6585
9,431,729 B2 * 8/2016 Kondo ..... H01R 9/034
9,431,768 B1 * 8/2016 Champion ..... H01R 13/6471
9,472,900 B1 * 10/2016 Phillips ..... H01R 13/6471
2010/0210124 A1 * 8/2010 Li ..... H01R 23/6873 439/108
2014/0127946 A1 * 5/2014 Ito ..... H01R 13/6599 439/629
2015/0249309 A1 * 9/2015 Dandl ..... H01R 13/112 439/682
2015/0255904 A1 * 9/2015 Ito ..... H01R 12/721 439/88
2016/0211629 A1 * 7/2016 Phillips ..... H01R 13/6471
2016/0240978 A1 * 8/2016 Yan ..... H01R 13/6471

* cited by examiner

HIGH-SPEED CONNECTOR WITH ELECTRICAL GROUND BRIDGE

BACKGROUND OF THE INVENTION

1. Field of the Invention

The instant invention relates to an electrical connector; in particular, to a high-speed connector with an electrical ground bridge.

2. Description of Related Art

The insertion loss or crosstalk of a conventional high-speed connector is usually reduced by using a grounding sheet to connect a plurality of grounding terminals thereof. The conventional grounding sheet includes a main portion and a plurality of elastic arms extended from the main portion. Each one of the elastic arms is embodied in a cantilever form, and the elastic arms and the main portion are formed by stamping a metal sheet. Thus, the material and thickness of each elastic arm is identical to that of the main portion.

However, each one of the elastic arms can be pressed to deform to contact one of the grounding terminals and to generate a normal force between the contact interface, thereby electrically connecting to the corresponding grounding terminal. The deformation of each elastic arm is relative to the compression stroke of the grounding terminal. The values of the deformations of the elastic arms can be summarized in a wide distribution because of accumulation of manufacturing tolerances, and the conventional grounding sheet cannot simultaneously satisfy two different functional demands, which are respectively corresponding to a smaller deformation in the wide distribution and a larger deformation in the wide distribution. Specifically, when the functional demand is corresponding to the smaller deformation in the wide distribution, the normal force provided from each elastic arm of the conventional grounding sheet is not large enough to maintain the electrical connection of each elastic arm and the corresponding grounding terminal. When the functional demand is corresponding to the larger deformation in the wide distribution, the normal force provided from each elastic arm of the conventional grounding sheet is difficult to be maintained at a suitable value to avoid insertion problems during mating with the counterpart, such as insertion difficulty, insertion force too large and yielding of the elastic arm or the grounding terminal.

Moreover, each elastic arm of the conventional grounding sheet is usually realized in a form of slender cantilever beam, which tends to be excited in a bending or torsional vibration, and the contact interface between each elastic arm and the corresponding grounding terminal is a point or a line. Thus, under shock or vibrating environment, at least one of the elastic arms may be instantly separated from the corresponding grounding terminal, which results in electrical discontinuity.

SUMMARY OF THE INVENTION

The instant disclosure provides a high-speed connector for effectively solving the problems inherent in the conventional high-speed connector.

The instant disclosure provides a high-speed connector, comprising: an insulating case having an inserting surface and an opposite mounting surface, wherein the insulating case has an inserting slot concavely formed on the inserting surface thereof, the insulating case has a plurality of terminal slots and at least one accommodating slot, and the terminal slots and the accommodating slot are in air communication with the inserting slot; a terminal module having a plurality of terminals respectively inserted into the terminal slots of the insulating case, wherein each terminal has a fixing segment and a swing segment swingable with respect to the fixing segment, part of each one of the swing segments is arranged in the inserting slot, wherein the terminals include a plurality of signal terminals and a plurality of grounding terminals; at least one electrical bridge inserted into the accommodating slot, wherein the position of the electrical bridge corresponds to at least two of the grounding terminals of the terminal module; and a plurality of conductive buffers positioned in the insulating case and contacted with the electrical bridge, wherein the conductive buffers are respectively arranged in the swing paths of the swing segments of the grounding terminals corresponding to the electrical bridge, each one of the conductive buffers is a resilient construction and is configured to transform from an initial state to a deformation state by pressing; wherein the swing segment of each grounding terminal corresponding to the electrical bridge is configured to swing to press the corresponding conductive buffer for causing the corresponding conductive buffer in the deformation state, thereby the corresponding buffer establishes an electrical connection path to electrically connect the electrical bridge and the corresponding grounding terminal.

In summary, the high-speed connector of the instant disclosure can be applied to a wide distribution of the compression deformations for achieving different demands of normal pressure and conductive property. Moreover, the high-speed connector of the instant disclosure is different from the conventional high-speed connector using an elongated cantilever mode, and the contact interface between the conductive buffer and the corresponding grounding terminal in the instant disclosure is a surface, which is different from the point contact or line contact of the conventional high-speed connector. Thus, the high-speed connector of the instant disclosure has a better withstanding against vibration and impact property than the conventional high-speed connector. The conductive buffer can be adapted to deformation requirement with adequate normal force and electrical connection, through optimal selection of construction and composition.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

[First Embodiment]

Please refer to FIGS. 1 through 8 which show a first embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 1:
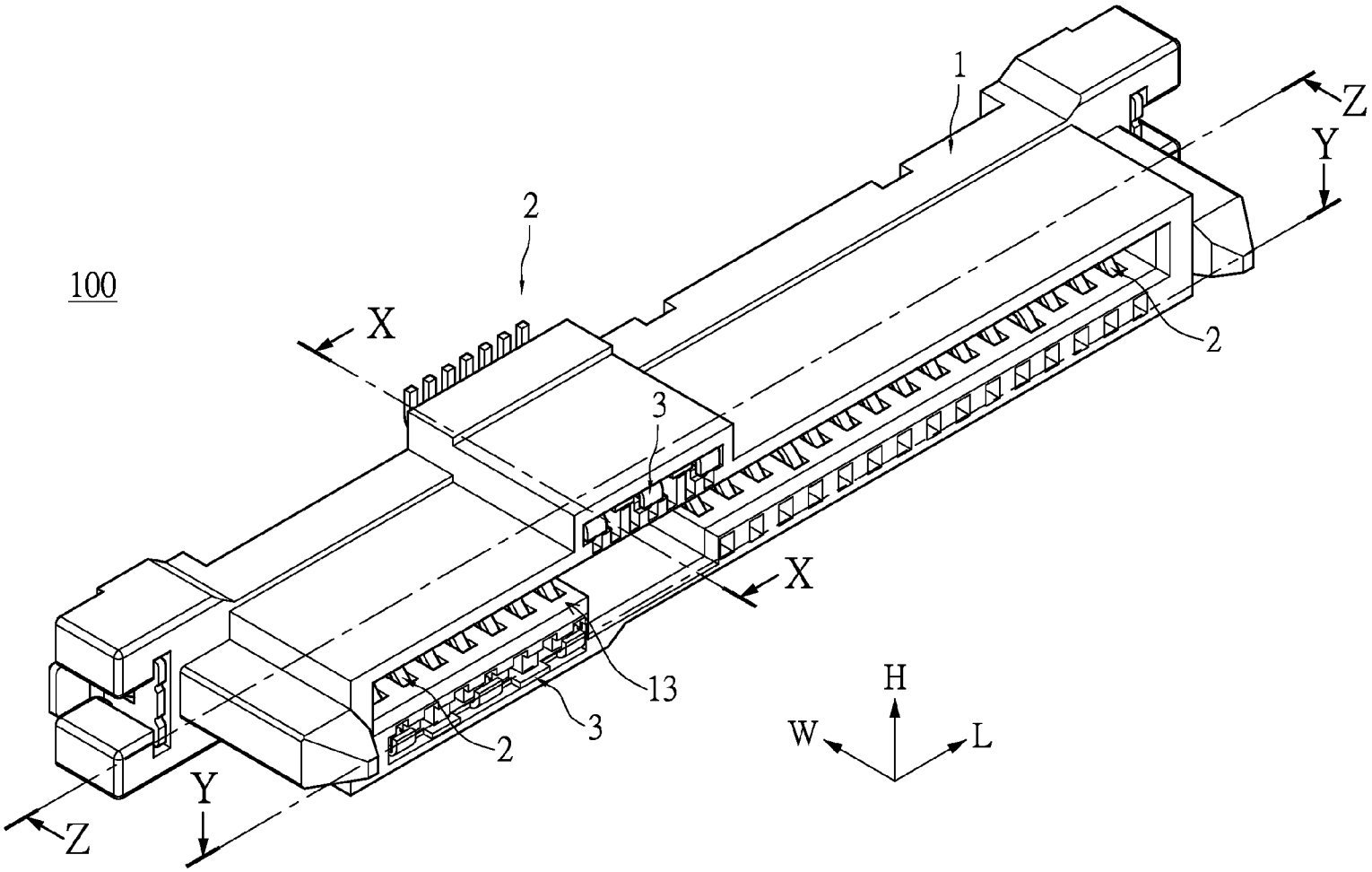
FIG. 1 is a perspective view showing a high-speed connector according to a first embodiment of the instant disclosure.
Figure 2:
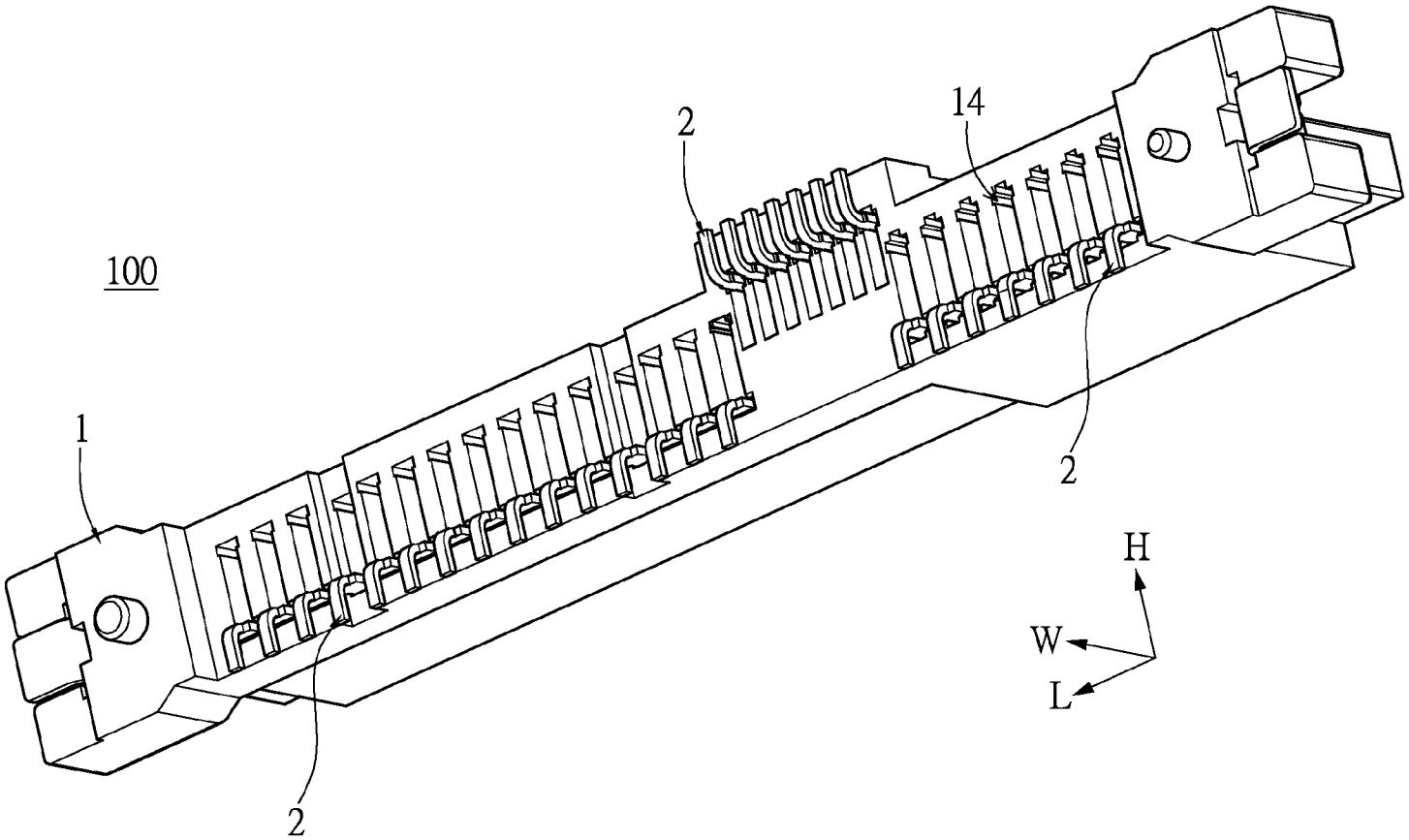
FIG. 2 is a perspective view of FIG. 1 from another perspective.
Figure 3:
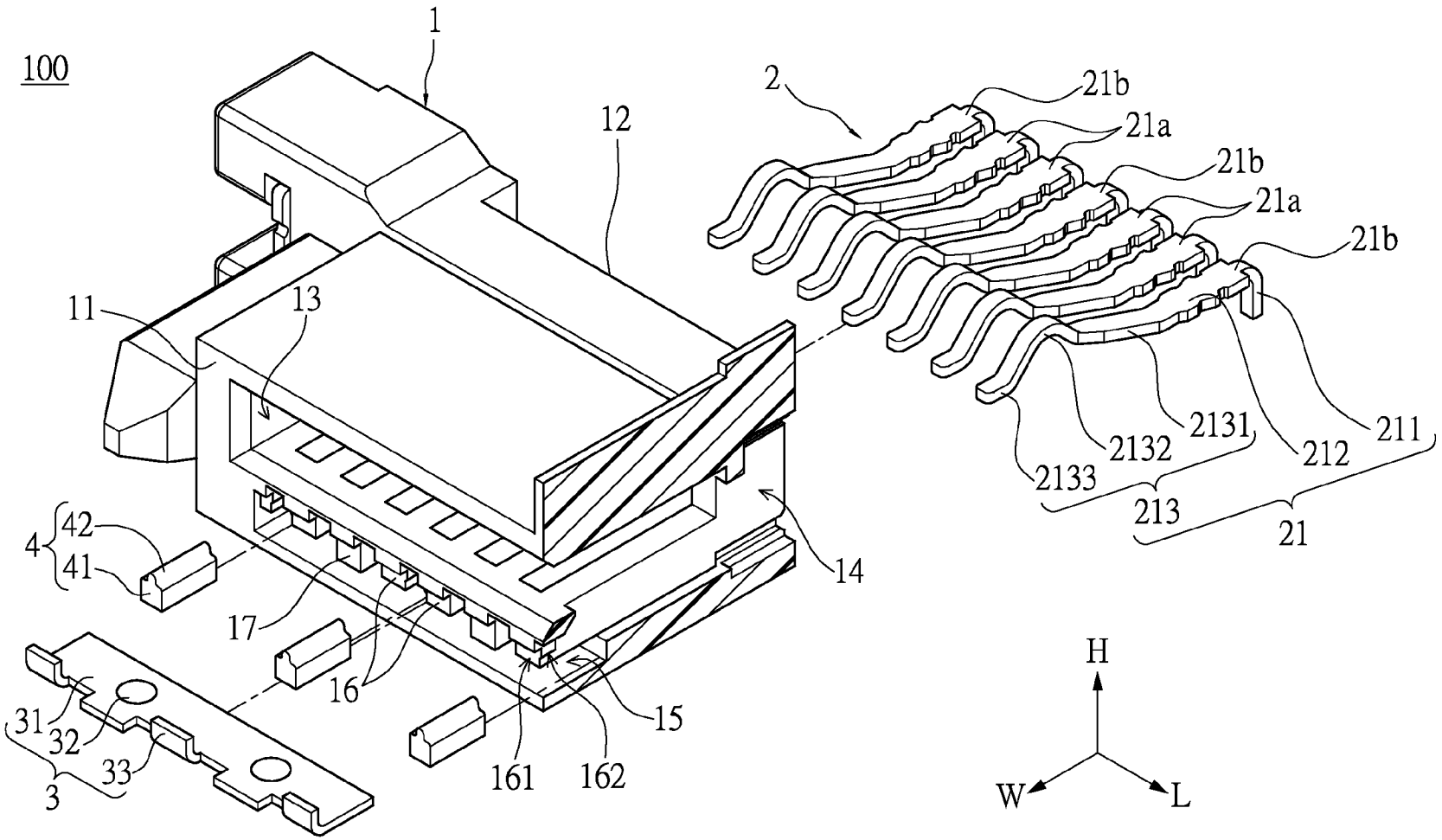
FIG. 3 is an exploded view of FIG. 1.

Please refer to FIGS. 1 through 3, which show a high-speed connector 100 of the instant embodiment. The high-speed connector 100 includes an elongated insulating case 1, three terminal modules 2, two electrical bridges 3, and a plurality of electrically conductive buffers 4. The terminal modules 2, the electrical bridges 3, and the conductive buffers 4 are disposed on the insulating case 1, the positions of the conductive buffers 4 are respectively corresponding to the two electrical bridges 3, and the positions of the electrical bridges 3 are respectively corresponding to two of the three terminal modules 2. In order to clearly explain the instant embodiment, the following description only describes the electrical bridge 3 as shown on the left side of FIG. 1 and the corresponding portion of the insulating case 1, the corresponding terminal module 2, and the corresponding conductive buffers 4.

Figure 4:
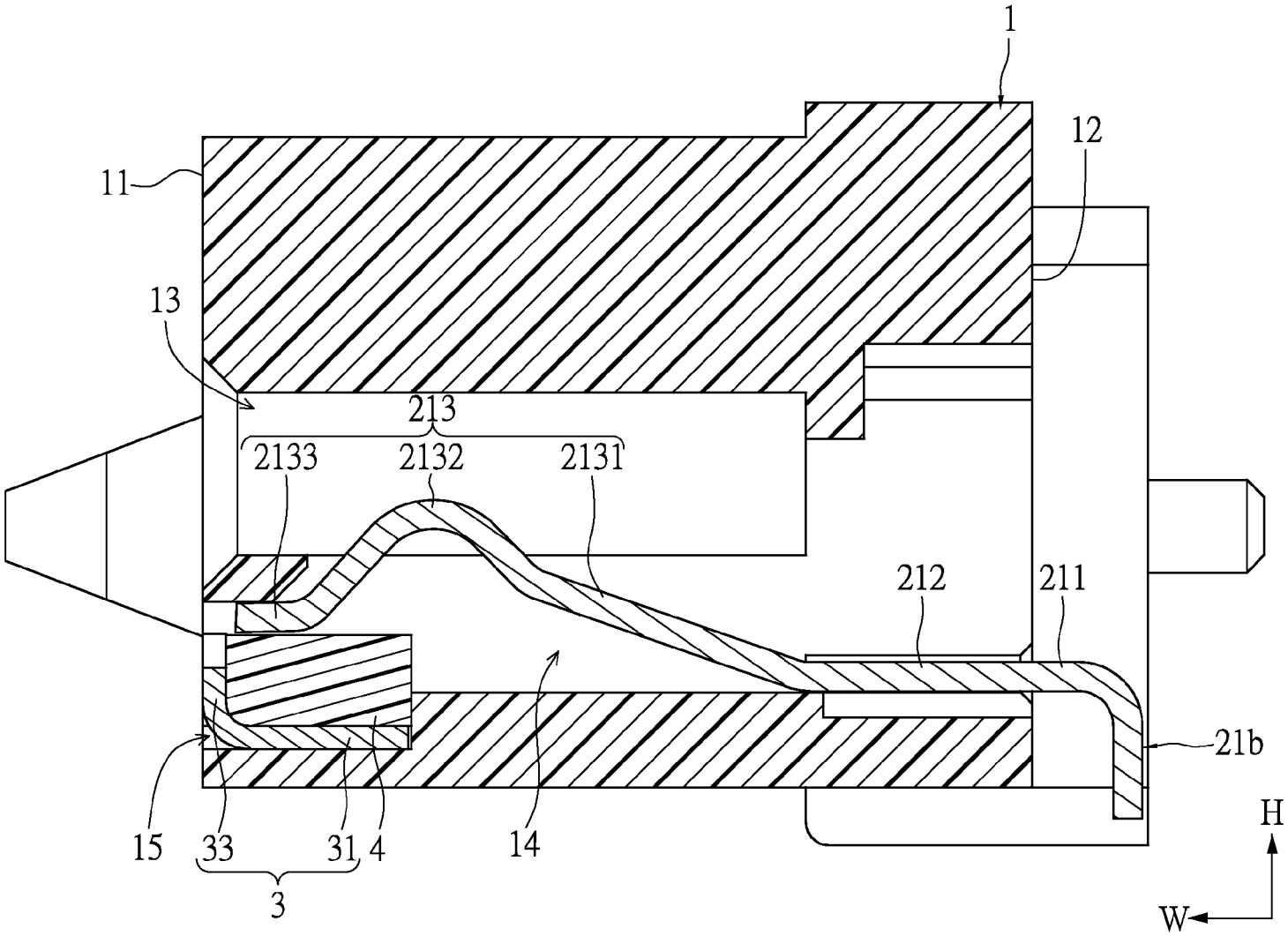
FIG. 4 is a cross-sectional view of FIG. 1 along a cross-sectional line X-X.
Figure 5:
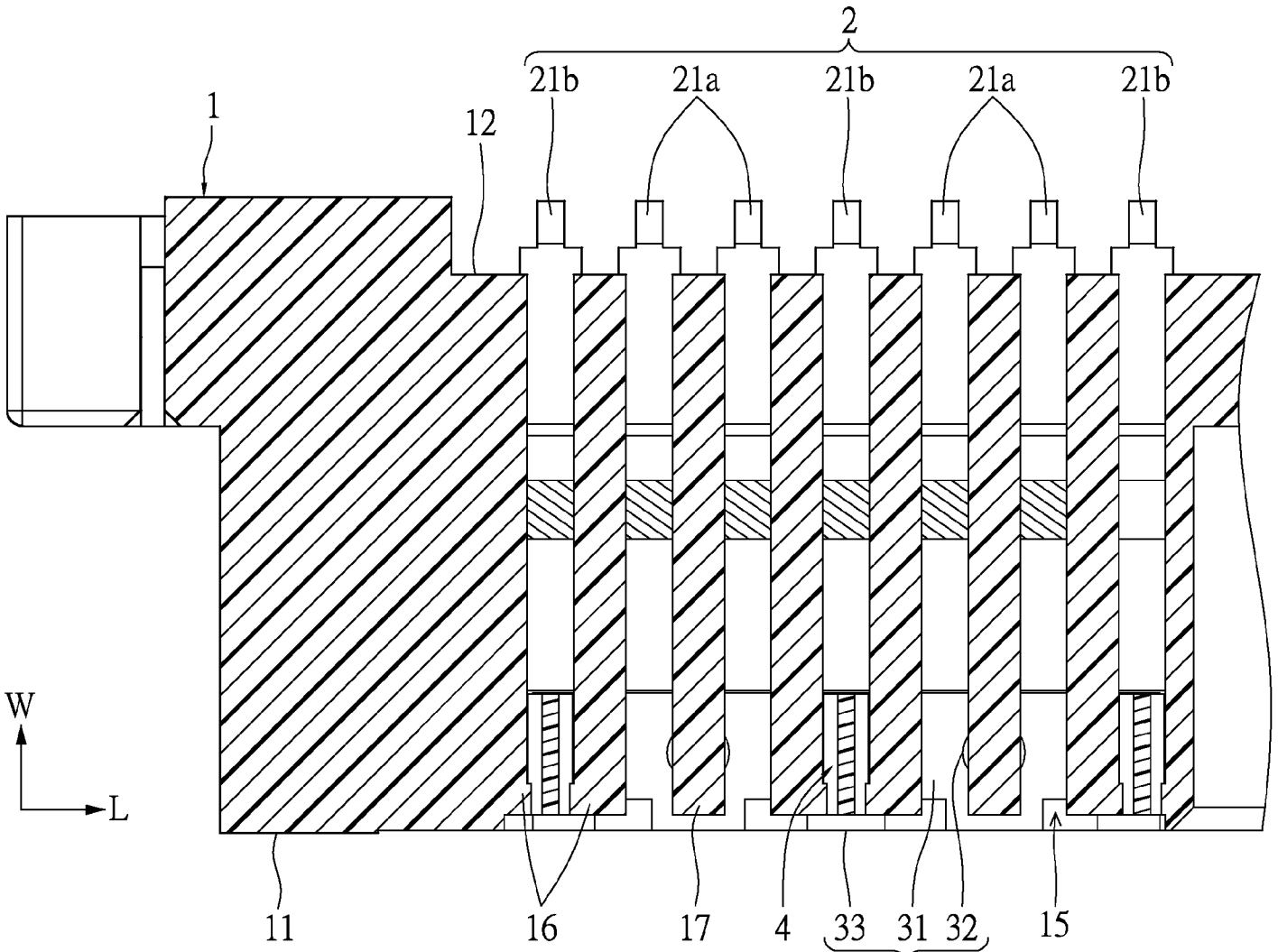
FIG. 5 is a cross-sectional view of FIG. 1 along a cross-sectional line Y-Y.
Figure 6:
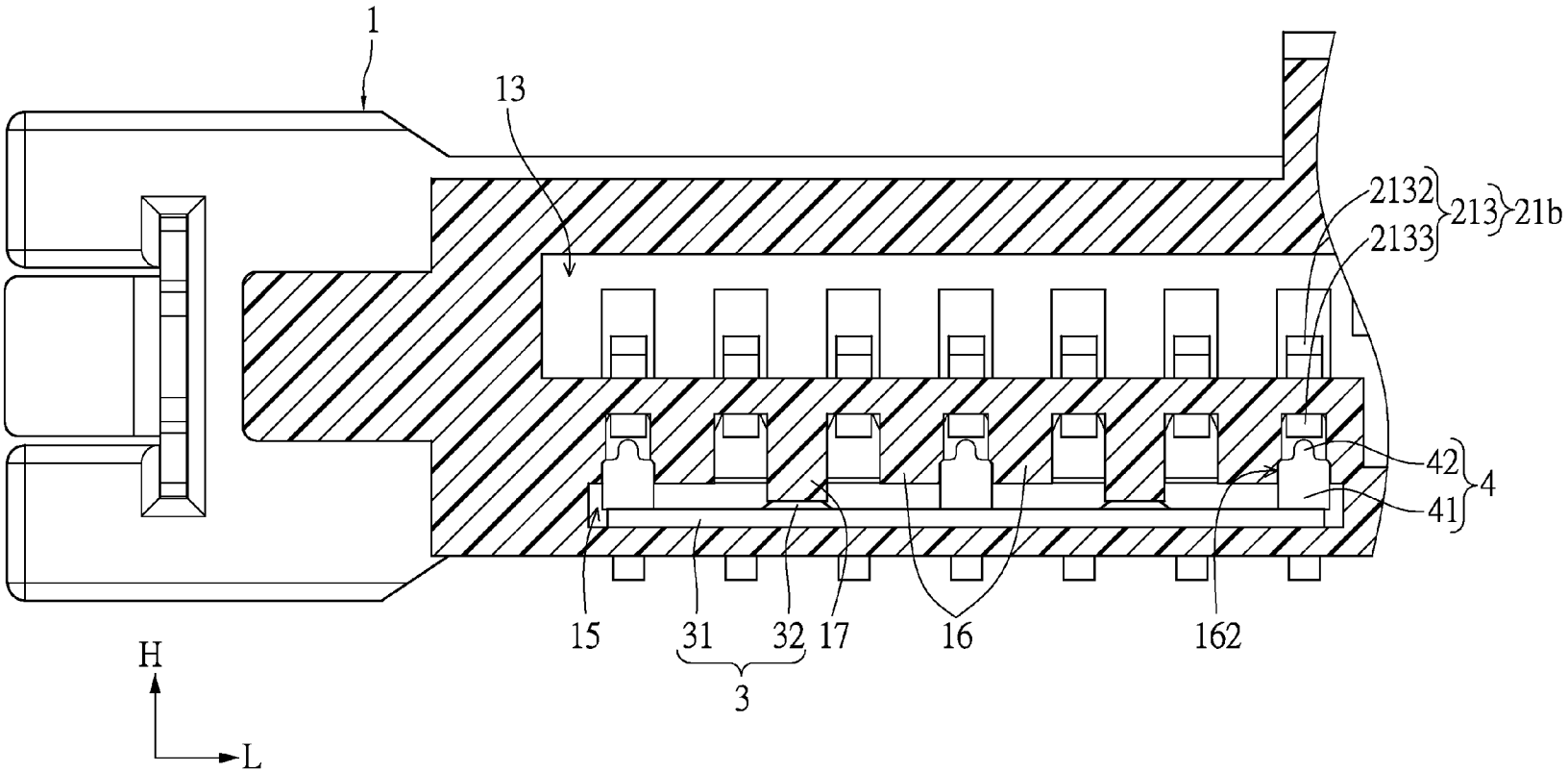
FIG. 6 is a cross-sectional view of FIG. 1 along a cross-sectional line Z-Z.

Please refer to FIG. 3, and with reference occasionally made to FIGS. 4 through 6. The insulating case 1 defines a longitudinal direction L, a width direction W, and a height direction H, which are perpendicular to each other. The insulating case 1 has an inserting surface 11 and a mounting surface 12, which are arranged at two opposite sides in the width direction W. A distance between the inserting surface 11 and the mounting surface 12 is parallel to the width direction W. An inserting slot 13 is concavely formed on the inserting surface 11 of the insulating case 1 in the width direction W, thereby providing insertion space for a mating connector (not shown) or an electronic card (not shown). The insulating case 1 has a plurality of terminal slots 14 and at least one accommodating slot 15, which are in air communication with the inserting slot 13. The terminal slots 14 in the instant embodiment penetrate from the inserting surface 11 to the mounting surface 12, and the accommodating slot 15 is communicated with the inserting slot 13 via the terminal slots 14.

Specifically, the insulating case 1 has a plurality of limiting columns 16 and a plurality of fixing columns 17, which are arranged corresponding to the accommodating slot 15. The longitudinal axis of each one of the limiting column 16 and the fixing column 17 is approximately parallel to the width direction W. The limiting columns 16 and the fixing columns 17 are spacedly arranged along the longitudinal direction L, and each fixing column 17 is arranged between two pairs of the limiting columns 16. The limiting columns 16 and the fixing columns 17 are configured to separate the terminal slots 14 and define a boundary of the accommodating slot 15.

The terminal module 2 has a plurality of terminals 21, and each terminal 21 has a connecting segment 211, a fixing segment 212, and a swing segment 213 swingable with respect to the fixing segment 212. The terminals 21 are respectively inserted into the terminal slots 14 of the insulating case 1 along the width direction W, and the terminals 21 are arranged in one row along the longitudinal direction L. The connecting segment 211 of each terminal 21 is arranged out of the corresponding terminal slot 14 and passes through the mounting surface 12, the fixing segment 212 of each terminal 21 is fixed on the corresponding terminal slot 14 (e.g., at least one barb is formed on one side of the fixing segment 212 for wedging into a side wall of the corresponding terminal slot 14), and part of the swing segment 213 of each terminal 21 is arranged in the corresponding inserting slot 13.

Specifically, the swing segment 213 of each terminal 21 includes a straight connecting portion 2131, a curved contacting portion 2132, and a straight free end portion 2133, which are integrally extended from the fixing segment 212 in sequence. The connecting portion 2131 is arranged in the corresponding terminal slot 14 and is aslant connected to the fixing segment 212, and the connecting portion 2131 and the connected fixing segment 212 define an obtuse angle. At least part of the contacting portion 2132 is arranged in the inserting slot 13, and a center of curvature of the contacting portion 2132 is approximately located in the terminal slot 14. The free end portion 2133 is arranged in the corresponding terminal slot 14 and does not protrude from the inserting surface 11 of the insulating case 1.

Moreover, the terminals 21 of the terminal module 2 include a plurality of signal terminals 21*a* and a plurality of grounding terminals 21*b*. The number of the terminals 21 of the terminal module 2 in the instant embodiment is seven, and the terminals 21 are arranged in sequence as the grounding terminal 21*b*, the signal terminal 21*a*, the signal terminal 21*a*, the grounding terminal 21*b*, the signal terminal 21*a*, the signal terminal 21*a*, and the grounding terminal 21*b*.

The conductive bridge 3 is made of an electrically conductive material. The conductive bridge 3 is inserted into the accommodating slot 15 of the insulating case 1 in the width direction W. The position of the electrical bridge 3 corresponds to at least two of the grounding terminals 21*b* of the terminal module 2, and the electrical bridge 3 is electrically isolated from the signal terminals 21*a*. The electrical bridge 3 in the instant embodiment is corresponding to all of the grounding terminals 21*b* of the terminal module 2, but is not limited thereto. The electrical bridge 3 includes a sheet 31, a plurality of positioning domes 32 formed on the sheet 31, and a plurality of stopping flanges 33 curvedly connected to the sheet 31.

Specifically, the sheet 31 has an elongated shape and the longitudinal axis of the sheet 31 is approximately parallel to the longitudinal direction L. The positions of the positioning domes 32 are respectively corresponding to the fixing columns 17 of the insulating case 1, and the electrical bridge 3 is fixed on the insulating case 1 by using the interference fits of the positioning domes 32 and the fixing columns 17 of the insulating case 1. The number of the stopping flanges 33 is identical to the number of the grounding terminals 21*b* of the terminal module 2, and the stopping flanges 33 are curvedly extended from a long edge of the sheet 31 to respectively correspond to the positions of the grounding terminals 21*b*.

The number of the conductive buffers 4 in the instant embodiment is identical to the number of the grounding terminals 21*b* of the terminal module 2, and the conductive buffers 4 are abutted against the sheet 31 of the electrical bridge 3 and are positioned in the insulating case 1.

Figure 7:
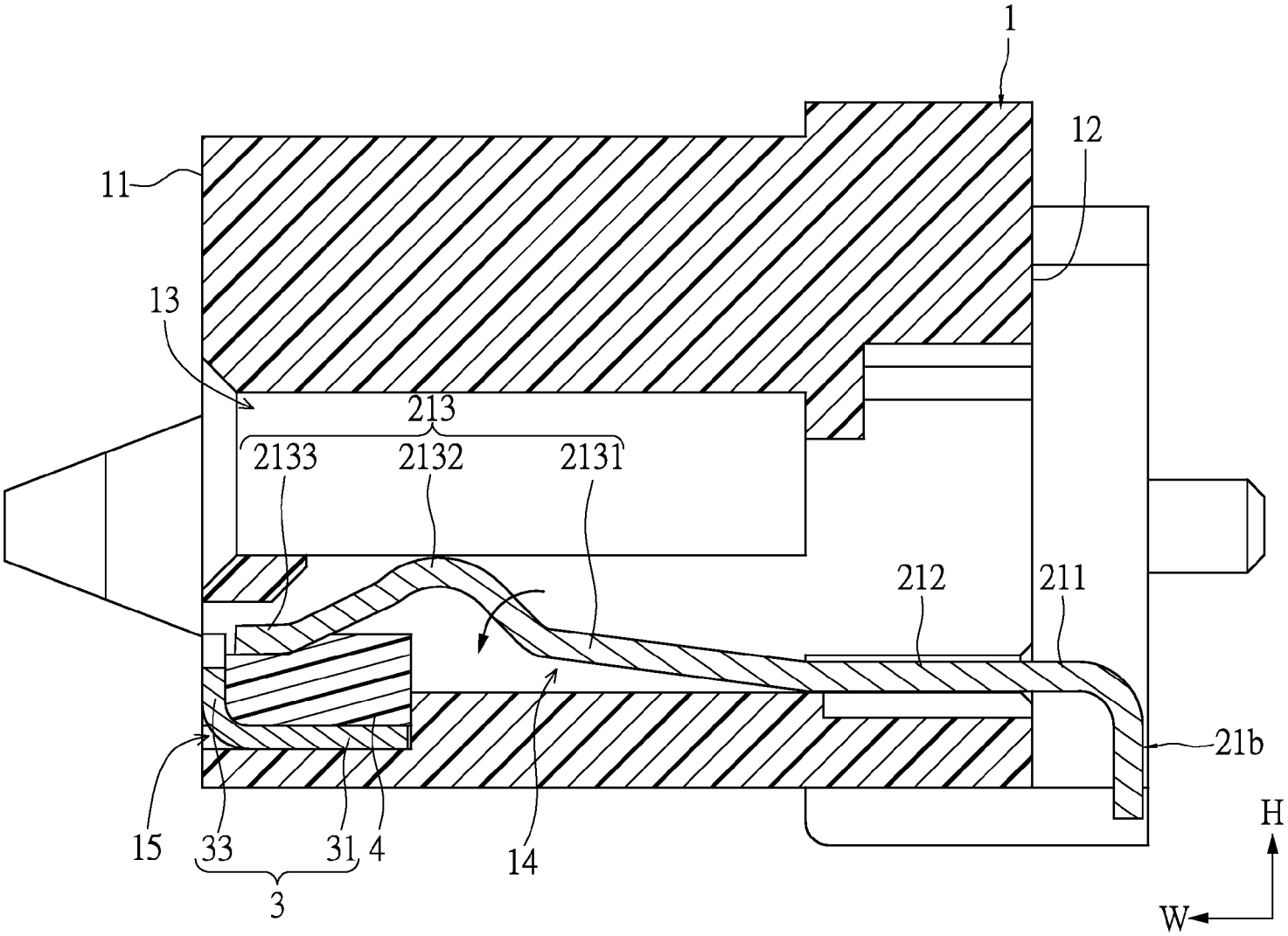
FIG. 7 is a first cross-sectional view showing the high-speed connector inserted by a non-shown mating connector.
Figure 8:
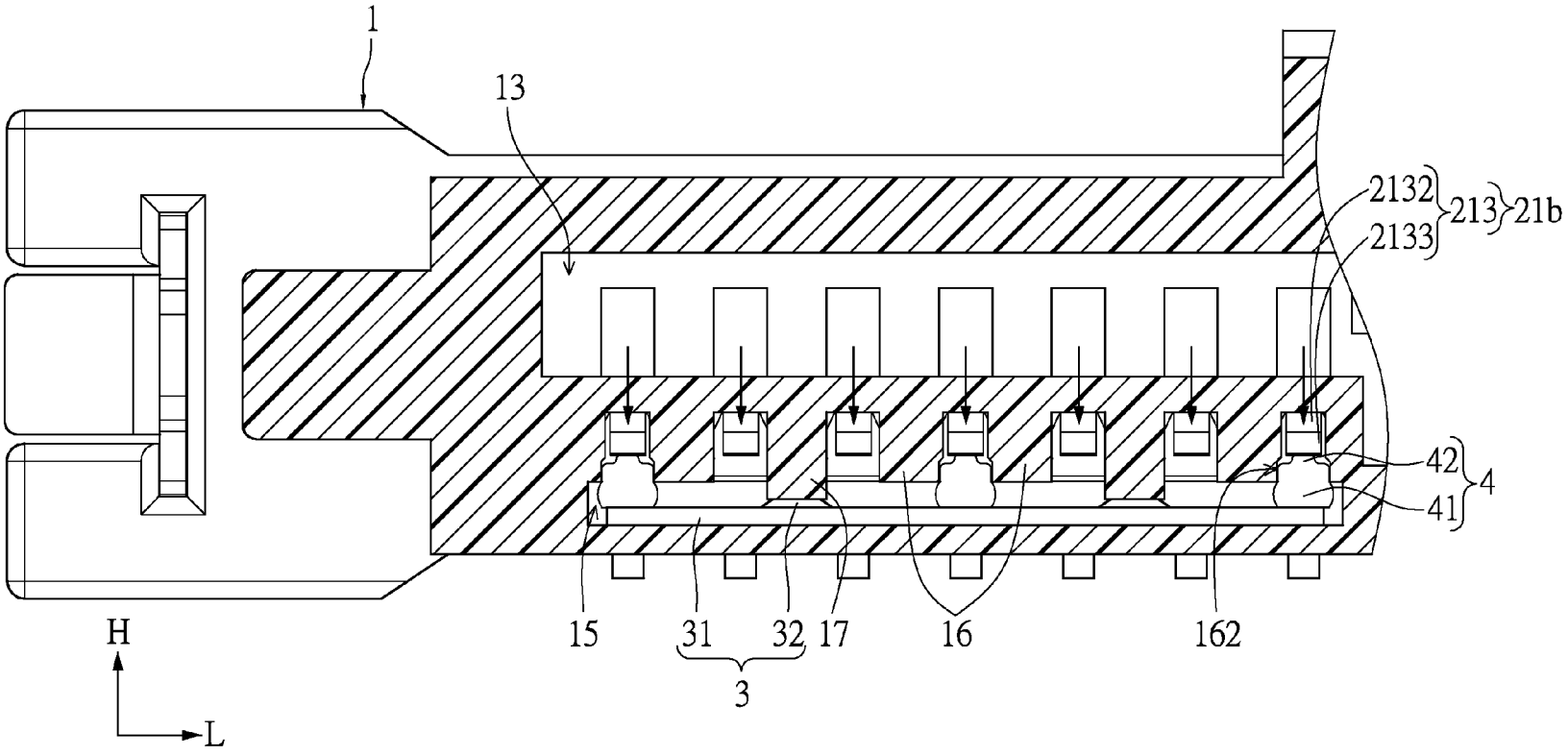
FIG. 8 is a second cross-sectional view showing the high-speed connector inserted by a non-shown mating connector.

First to describe the construction and working principle of the conductive buffers 4, the conductive buffer 4 is a resilient construction, and the conductive buffer 4 consists of an elastomer mixed with a plurality of conductive particles. Each conductive buffer 4 is configured to transform from an initial state (as shown in FIGS. 4 through 6) to a deformation state (as shown in FIGS. 7 and 8) by pressing. When each conductive buffer 4 is in the initial state, the conductive particles do not establish any electrical connection path because a first distance between any two adjacent conductive particles is too large; when each conductive buffer 4 is in the deformation state, the conductive particles are electrically connected with each other to establish an electrical connection path in a pressing direction because a second distance between any two adjacent conductive particles is very close, and the second distance is smaller than the first distance.

Moreover, the construction and composition of the conductive buffer 4 can be modified to be adapted to different application conditions, so as to achieve adequate electrical connection and normal force for the required deformation. In the instant embodiment, the conductive buffers 4 are respectively arranged in the swing paths of the free end portions 2133 of the swing segments 213 of the grounding terminals 21*b*, and each fixing segment 212 is configured to be a fulcrum of the corresponding free end portion 2133, so a moving distance of the free end portion 2133 is greater than that of the contacting portion 2132, thereby the conductive buffer 4 will have a relatively large compression amount. Accordingly, the conductive buffer 4 in the instant embodiment adopts the construction as shown in FIG. 3. However, the conductive buffers 4 of the instant embodiment cannot be arranged in the swing paths of the contacting portions 2132 of the swing segments 213 of the grounding terminals 21*b*, which are corresponding to the electrical bridge 3.

Specifically, each conductive buffer 4 in the instant embodiment includes a bottom portion 41 having a cuboid construction and a top portion 42 integrally extended from the bottom portion 41. In a cross-section of the conductive buffer 4 perpendicular to the width direction W (as shown in FIG. 6), the bottom width of the top portion 42 is smaller than the bottom width of the bottom portion 41, the deformation of the conductive buffer 4 mainly occurs to the top portion 42 so as to adjust adequate normal forces, thereby avoiding an insertion problem during mating with the counterpart(not shown).

Two side surfaces of each conductive buffer 4 (i.e., middle part of the side surfaces of the conductive buffer 4 as shown in FIG. 6) are respectively arranged adjacent to two side surfaces of two of the limiting columns 16, which are facing with each other. In the width direction W (as shown in FIGS. 4 and 5), one end of each conductive buffer 4 (i.e., the top end of each conductive buffer 4 as shown in FIG. 5) is disposed on a bottom of the accommodating slot 15, and another end of the conductive buffers 4 (i.e., the bottom end of the conductive buffers 4 as shown in FIG. 5) are respectively abutted against the stopping flanges 33.

As shown in FIG. 3, a notch 161 is formed on a portion of each limiting column 16 adjacent to the inserting surface 11, and the stopping flanges 33 of the electrical bridge 3 are respectively arranged in the notches 161 and are contacted with the limiting columns 16 and the conductive bridge 4. As shown in FIGS. 3 and 6, the lower half parts of two side surfaces of any two adjacent limiting columns 16 facing with each other respectively have two cutaways 162. Two corners of the upper half parts of the bottom portion 41 of each conductive buffer 4 are respectively arranged in the cutaways 162 of the adjacent two limiting columns 16, thereby the cutaways 162 of the adjacent limiting columns 16 and the sheet 31 of the electrical bridge 3 can position the conductive buffers 4 in the height direction H. The lower part of the bottom portion 41 of each conductive buffer 4 is arranged in the accommodating slot 15.

In addition, each one of the conductive buffers 4 in the instant embodiment is of the construction as shown in FIG. 3 for example, but the construction of each conductive buffer 4 can be changed according to the designe demand. For example, in a non-shown embodiment, the construction of each conductive buffer 4 can be changed to another form corresponding to a new arrangement, in which the conductive buffers 4 are respectively arranged in the swing paths of the contacting portions 2132 of the swing segments 213 of the grounding terminals 21*b*.

The constructions and relationships of the components of the high-speed connector 100 of the instant embodiment have been disclosed in the above description, and the following description discloses the operation of the high-speed connector 100 when a mating connector (not shown) or an electronic card (not shown) is inserted into the high-speed connector 100.

As shown in FIGS. 7 and 8, when the mating connector (not shown) or the electronic card (not shown) is inserted into the high-speed connector 100 of the instant embodiment, the contacting portions 2132 of the swing segments 213 of the terminals 21 are pressed to swing by the mating connector or the electronic card, such that the free end portions 2133 of the swing segments 213 of the grounding terminals 21*b* respectively press the conductive buffers 4 in the height direction H causing each conductive buffer 4 to be in the deformation state. When each conductive buffer 4 transforms from the initial state to the deformation state, each side surface of each conductive buffer 4 is deformed to extend toward a proximity space. Moreover, when each conductive buffer 4 transforms from the initial state to the deformation state, electrical connection paths can be created through the conductive buffer 4 in the height direction H. Besides, in the interfaces between the conductive buffers 4 and the corresponding contacting portion 2132 of the swing segment 213, and in the interfaces between the conductive buffers 4 and the corresponding electrical bridge 3, the conductive particles on the surfaces of the conductive buffers 4 can create multiple electrical connections across the interfaces under compression forces. In this way each one of the deformed conductive buffers 4 can electrically connect the corresponding grounding terminal 21 and the electrical bridge 3.

Specifically, when the top portion 42 of each conductive buffer 4 is pressed by the free end portion 2133 of the corresponding grounding terminal 21*b*, the lower part of the bottom portion 41 of each conductive buffer 4 is deformed to extend toward the accommodating slot 15 in the longitudinal direction L and the height direction H, and the main deformation in the height direction H occurs in the top portion 42, in addition to some deformation of the bottom portion 41 in the height direction H, while the region without constraint by the adjacent limiting columns 16 in the lower part of the bottom portion 41 of each conductive buffer 4 is deformed to extend toward the accommodating slot 15 in the longitudinal direction L and the height direction H. That is to say, each conductive buffer 4 has a portion non-contacted with the adjacent limiting columns 16 for deforming in the longitudinal direction L and the height direction H when the conductive buffer 4 is pressed. Moreover, each one of the deformed conductive buffers 4 can establish the electrical connection path to electrically connect the corresponding grounding terminal 21*b* and the electrical bridge 3.

[Second Embodiment]

Please refer to the FIGS. 9 through 14, which show a second embodiment of the instant disclosure. The second embodiment is similar to the first embodiment, so the same features are not disclosed again. The main different features of the two embodiments are the relative position of the conductive buffers 4, the insulating case 1, and the corresponding terminal module 2, and this different features are disclosed as follows.

Figure 9:
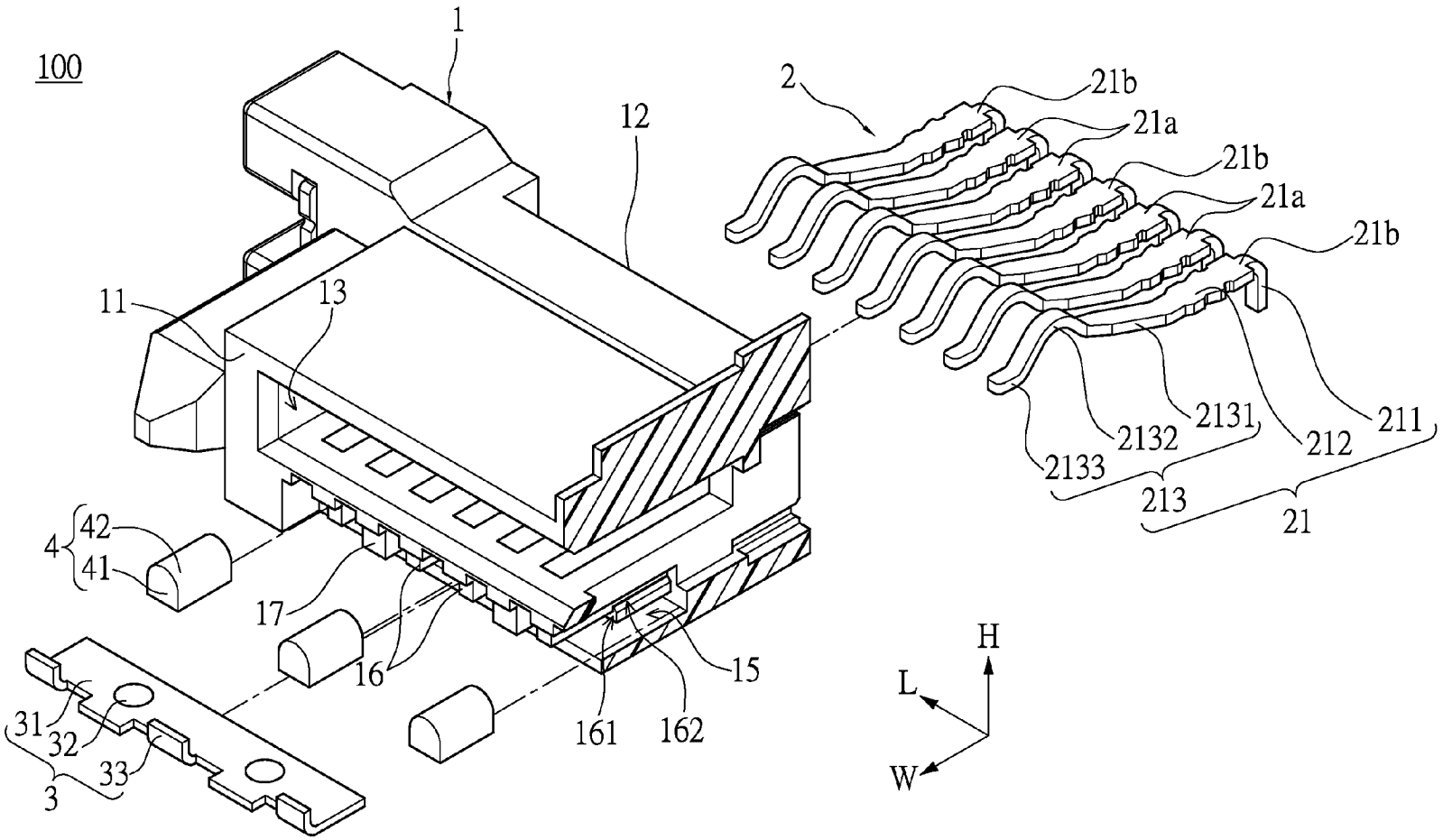
FIG. 9 is an exploded view showing a high-speed connector according to a second embodiment of the instant disclosure.
Figure 10:
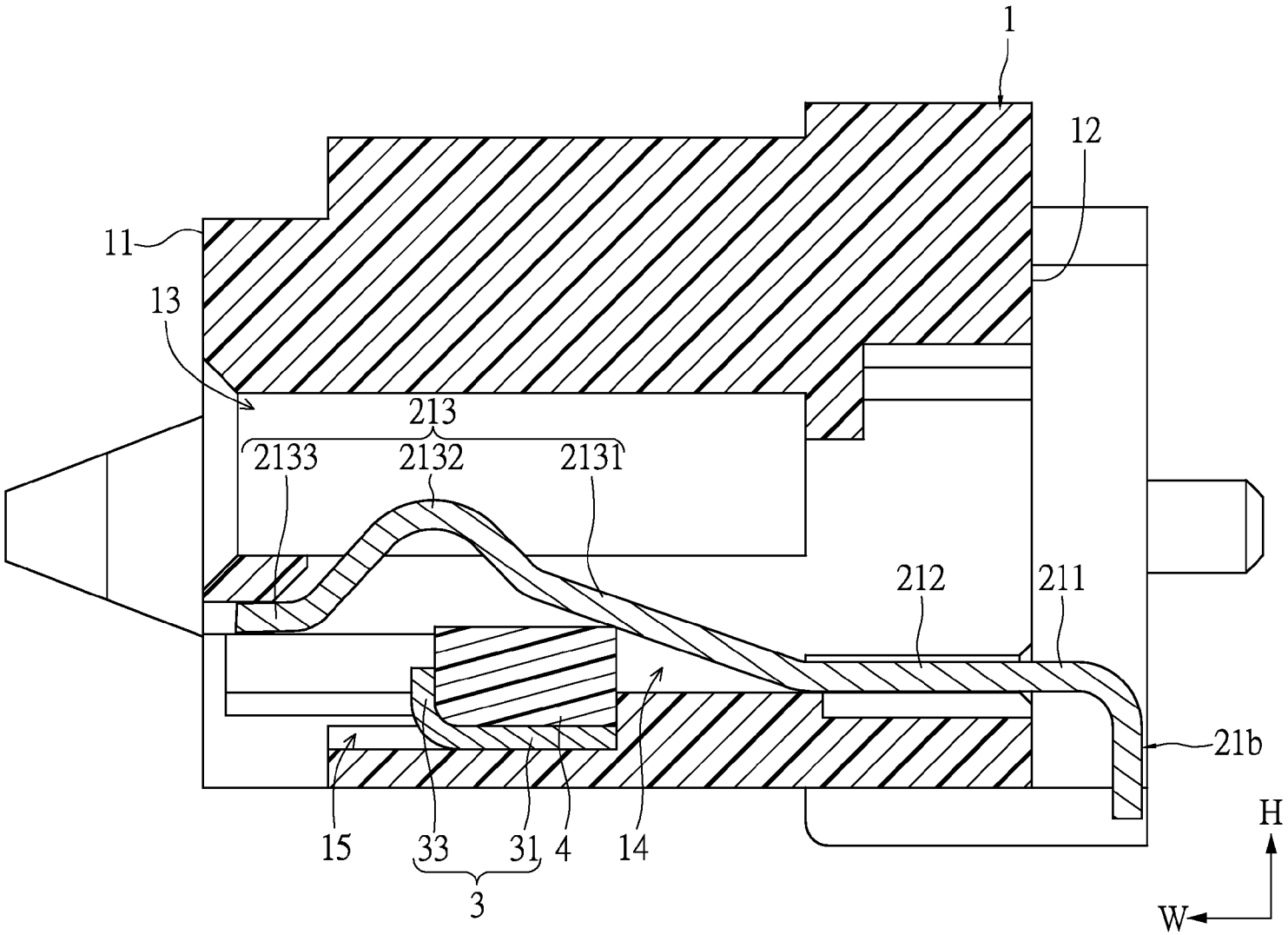
FIG. 10 is a first cross-sectional view of FIG. 9.
Figure 11:
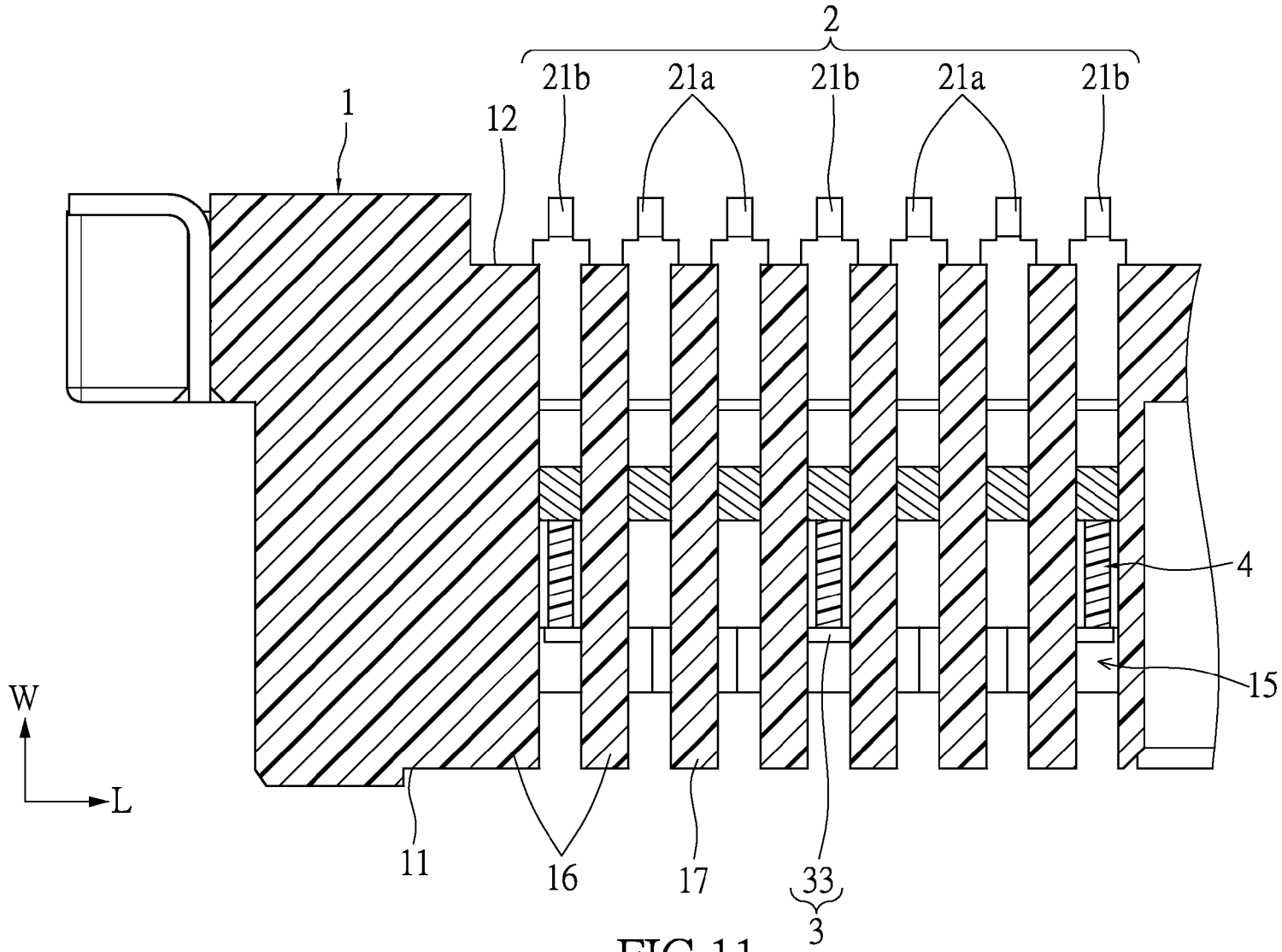
FIG. 11 is a second cross-sectional view of FIG. 9.
Figure 12:
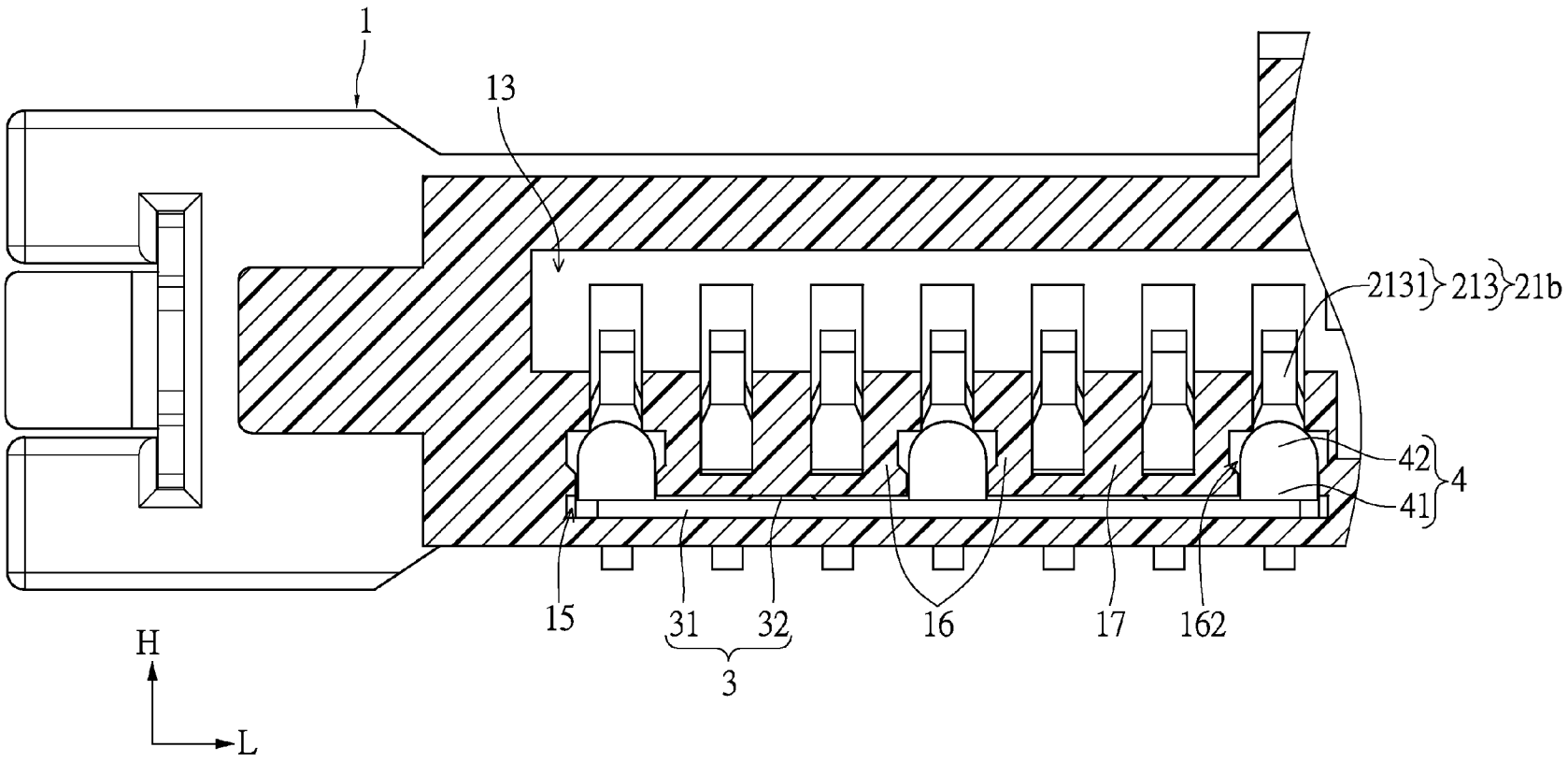
FIG. 12 is a third cross-sectional view of FIG. 9.
Figure 13:
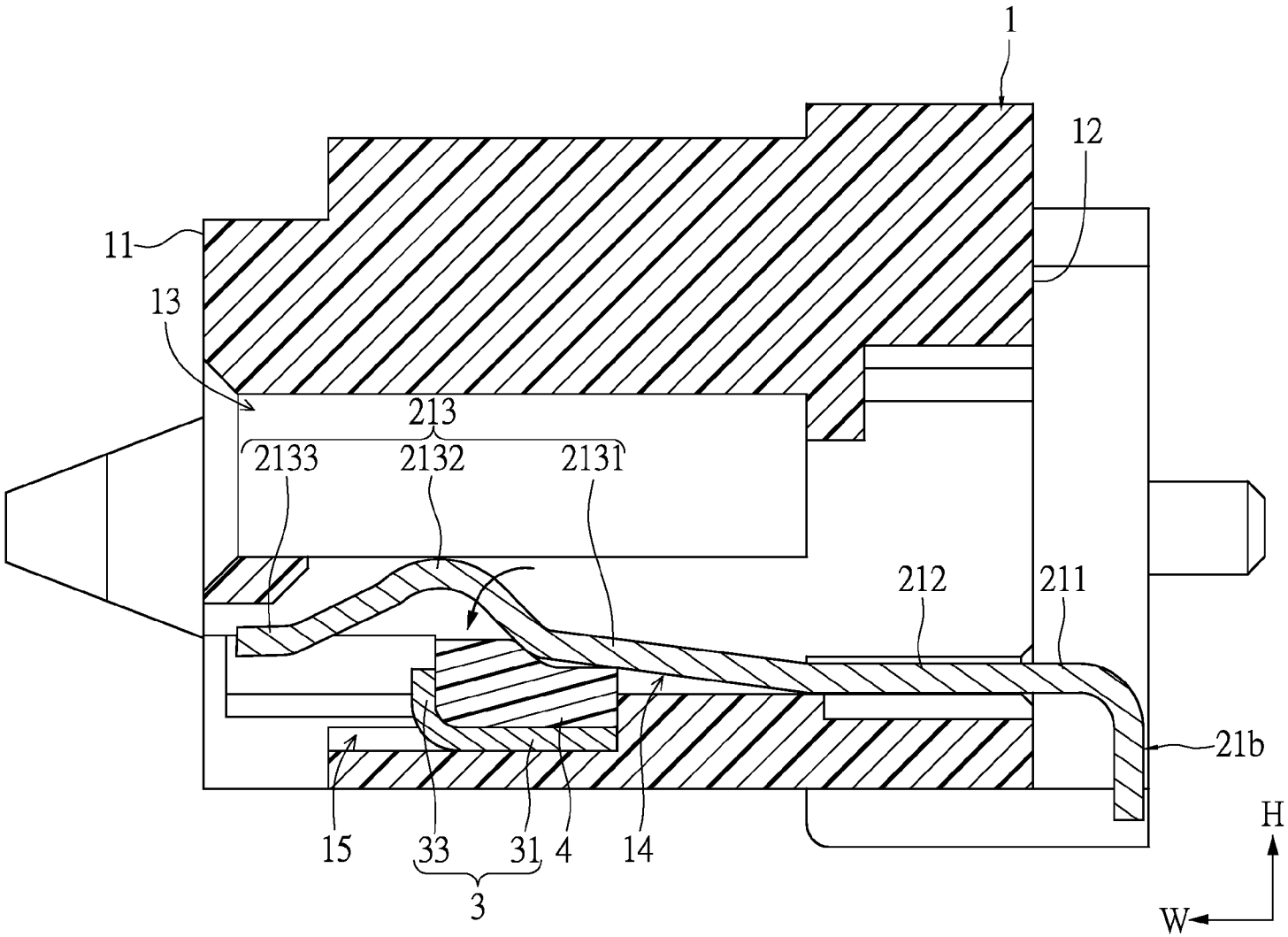
FIG. 13 is a first cross-sectional view showing the high-speed connector of the second embodiment inserted by a non-shown mating connector.
Figure 14:
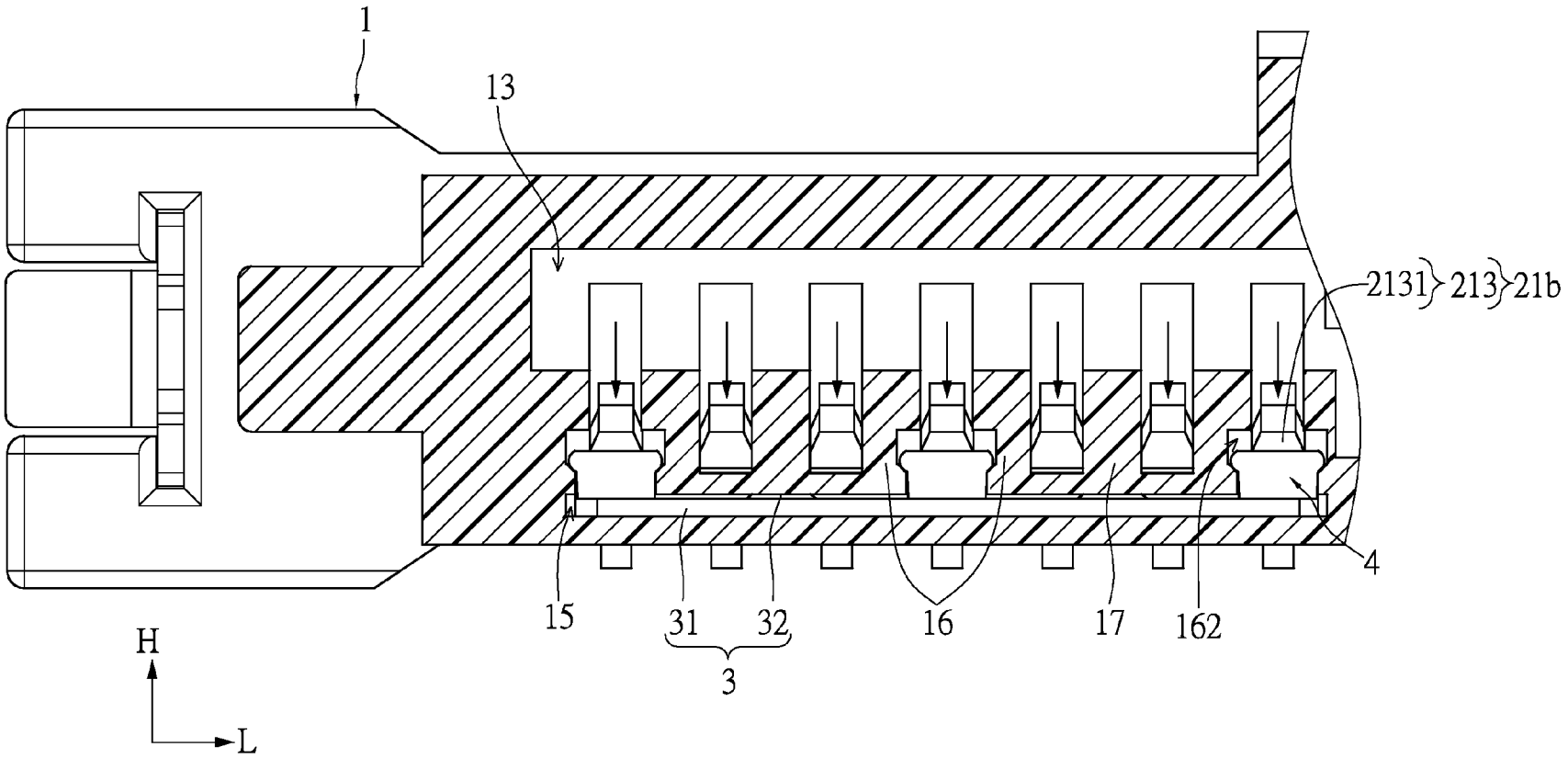
FIG. 14 is a second cross-sectional view showing the high-speed connector of the second embodiment inserted by a non-shown mating connector.

Please refer to FIG. 9, and with reference occasionally made to FIGS. 10 through 12. The conductive buffers 4 in the instant embodiment are respectively arranged in the swing paths of the connecting portions 2131 of the swing segments 213 of the grounding terminals 21*b*, which are corresponding to the electrical bridge 3. Thus, when the instant embodiment is compared to the first embodiment, a depth of the accommodating slot 15 of the insulating case 1 with respect to the width direction W in the instant embodiment is deeper than that of the first embodiment, and the positions of the notches 161 and the cutaways 162 of the limiting columns 16 in the instant embodiment is adjusted according to the deeper accommodating slot 15 (as shown in FIGS. 9 and 12).

Moreover, the conductive buffers 4 are respectively arranged in the swing paths of the connecting portions 2131 of the swing segments 213 of the grounding terminals 21*b*, and each fixing segment 212 is configured to be a fulcrum of the corresponding connecting portion 2131, so a moving distance of the connecting portion 2131 is smaller than that of the contacting portion 2132, thereby the conductive buffer 4 will have a smaller compression. Accordingly, each conductive buffer 4 in the instant embodiment adopts the construction as shown in FIG. 9. Specifically, each conductive buffer 4 in the instant embodiment includes a bottom portion 41 having a cuboid construction and a semi-cylinder top portion 42 integrally extended from the bottom portion 41. In a cross-section of the conductive buffer 4 perpendicular to the width direction W (as shown in FIG. 12), the width of the bottom portion 41 with respect to the longitudinal direction L is approximately identical to a maximum width of the top portion 42 with respect to the longitudinal direction L.

As shown in FIGS. 9 and 12, the upper half parts of two side surfaces of any two adjacent limiting columns 16 facing with each other respectively have two cutaways 162, and the lower part of the bottom portion 41 of the conductive buffer 4 is arranged between the lower half parts of the side surfaces of two adjacent limiting columns 16, which are facing with each other and are not formed with any cutaway 162. The upper part of the bottom portion 41 of the conductive buffer 4 is arranged partly constrained on the edges of the corresponding terminal slot 14.

In addition, each conductive buffer 4 in the instant embodiment is of the construction as shown in FIG. 9 for example, but the construction of each conductive buffer 4 can be changed according to functional demand, and is not limited to the figures of the instant embodiment.

Accordingly, when the top portion 42 of each conductive buffer 4 is pressed by the connecting portion 2131 of the corresponding grounding terminal 21*b*, the bottom portion 41 of each conductive buffer 4 is deformed mainly in the height direction H, while the un-constrained upper part of the conductive buffer 4 is deformed to extend toward the adjacent cutaway 162 in the longitudinal direction L and the height direction H. That is to say, each conductive buffer 4 has a portion non-contacted with the adjacent limiting columns 16 for deforming in the longitudinal direction L and the height direction H when the conductive buffer 4 is pressed. Moreover, each one of the deformed conductive buffers 4 can establish the electrical connection path to electrically connect the corresponding grounding terminal 21*b* and the electrical bridge 3.

[The Possible Effect of the Instant Disclosure]

In summary, the high-speed connector of the instant disclosure can be applied to a wide distribution of compression deformations for achieving different demands of normal force and conductive property. Moreover, the high-speed connector of the instant disclosure is different from the conventional high-speed connector using an elongated cantilever beam, and the contact interface between each conductive buffer and the corresponding grounding terminal in the instant disclosure is a surface, which is different from the point contact or line contact of the conventional high-speed connector. Thus, the high-speed connector of the instant disclosure has a better withstanding against vibration and impact property than the conventional high-speed connector.

In addition, the insulating case of the instant disclosure has a plurality of positioning constructions for stably fixing the electrical bridge and the conductive buffers in the insulating case, and the positioning constructions can be changed according to design demand.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A high-speed connector with an electrical ground bridge, comprising:

an insulating case having an inserting surface and an opposite mounting surface, wherein the insulating case has an inserting slot concavely formed on the inserting surface thereof, the insulating case has a plurality of terminal slots and at least one accommodating slot, and the terminal slots and the accommodating slot are in air communication with the inserting slot;

a terminal module having a plurality of terminals respectively inserted into the terminal slots of the insulating case, wherein each terminal has a fixing segment and a swing segment swingable with respect to the fixing segment, part of each one of the swing segments is arranged in the inserting slot, wherein the terminals include a plurality of signal terminals and a plurality of grounding terminals;

at least one electrical bridge inserted into the accommodating slot, wherein the position of the electrical bridge corresponds to at least two of the grounding terminals of the terminal module; and a plurality of conductive buffers positioned in the insulating case and contacted with the electrical bridge, wherein the conductive buffers are respectively arranged in the swing paths of the swing segments of the grounding terminals corresponding to the electrical bridge, each one of the conductive buffers is a resilient construction and is configured to transform from an initial state to a deformation state by pressing;

wherein the swing segment of each grounding terminal corresponding to the electrical bridge is configured to swing, to press the corresponding conductive buffer for causing the corresponding conductive buffer to be in the deformation state, thereby the corresponding buffer establishes an electrical connection path to electrically connect the electrical bridge and the corresponding grounding terminal, wherein each one of the conductive buffers is formed by an elastomer mixed with a plurality of conductive particles; when each one of the conductive buffers is in the initial state, the conductive particles do not establish the electrical connection path, when each one of the conductive buffers is in the deformation state, the conductive particles establish the electrical connection path.

2. The high-speed connector as claimed in claim 1, wherein the electrical bridge has a sheet and a plurality of positioning domes formed on the sheet, and the electrical bridge is fixed on the insulating case by using the interference fits of the positioning domes and the insulating case.

3. The high-speed connector as claimed in claim 2, wherein the electrical bridge has a plurality of stopping flanges, the stopping flanges are curvedly connected to the sheet, an end of each conductive buffer is arranged on a bottom of the accommodating slot, and the other end of each conductive buffer is respectively contacted with the stopping flange.

4. The high-speed connector as claimed in claim 3, wherein the insulating case has a plurality of limiting columns, the limiting columns separate the terminal slots and define a boundary of the accommodating slot, two side surfaces of each one of the conductive buffers are respectively arranged adjacent to two side surfaces of two of the limiting columns facing with each other.

5. The high-speed connector as claimed in claim 4, wherein when each one of the conductive buffers is pressed to transform from the initial state to the deformation state, each side surface of the corresponding conductive buffer is deformed to extend toward a proximity space.

6. The high-speed connector as claimed in claim 4, wherein a notch is formed on a portion of each limiting column adjacent to the inserting surface, the stopping flanges of the electrical bridge are respectively arranged in the notches and are respectively contacted with the limiting columns.

7. The high-speed connector as claimed in claim 4, wherein the two side surfaces facing each other of any two adjacent limiting columns respectively have cutaways; when each one of the conductive buffers is pressed to transform from the initial state to the deformation state, the side surfaces of the conductive buffers are deformed to respectively extend toward the cutaways.

8. The high-speed connector as claimed in claim 1, wherein the swing segment of each one of the grounding terminals has a connecting portion, a contacting portion, and a free end portion arranged in sequence, wherein the conductive buffers are respectively arranged in the swing paths of the free end portions of the swing segments of the grounding terminals corresponding to the electrical bridge.

9. The high-speed connector as claimed in claim 1, wherein the swing segment of each one of the grounding terminals has a connecting portion, a contacting portion, and a free end portion arranged in sequence, wherein the conductive buffers are respectively arranged in the swing paths of the connecting portions of the swing segments of the grounding terminals corresponding to the electrical bridge.

10. A high-speed connector with an electrical ground bridge, comprising:

an insulating case having an inserting surface and an opposite mounting surface, wherein the insulating case has an inserting slot concavely formed on the inserting surface thereof, the insulating case has a plurality of terminal slots and at least one accommodating slot, and the terminal slots and the accommodating slot are in air communication with the inserting slot;

a terminal module having a plurality of terminals respectively inserted into the terminal slots of the insulating case, wherein each terminal has a fixing segment and a swing segment swingable with respect to the fixing segment, part of each one of the swing segments is arranged in the inserting slot, wherein the terminals include a plurality of signal terminals and a plurality of grounding terminals;

at least one electrical bridge inserted into the accommodating slot, wherein the position of the electrical bridge corresponds to at least two of the grounding terminals of the terminal module; and a plurality of conductive buffers positioned in the insulating case and contacted with the electrical bridge, wherein the conductive buffers are respectively arranged in the swing paths of the swing segments of the grounding terminals corresponding to the electrical bridge, each one of the conductive buffers is a resilient construction and is configured to transform from an initial state to a deformation state by pressing;

wherein the swing segment of each grounding terminal corresponding to the electrical bridge is configured to swing, to press the corresponding conductive buffer for causing the corresponding conductive buffer to be in the deformation state, thereby the corresponding buffer establishes an electrical connection path to electrically connect the electrical bridge and the corresponding grounding terminal, wherein the electrical bridge has a sheet and a plurality of positioning domes formed on the sheet, and the electrical bridge is fixed on the insulating case by using the interference fits of the positioning domes and the insulating case.

11. The high-speed connector as claimed in claim 10, wherein the electrical bridge has a plurality of stopping flanges, the stopping flanges are curvedly connected to the sheet, an end of each conductive buffer is arranged on a bottom of the accommodating slot, and the other end of each conductive buffer is respectively contacted with the stopping flange.

12. The high-speed connector as claimed in claim 11, wherein the insulating case has a plurality of limiting columns, the limiting columns separate the terminal slots and define a boundary of the accommodating slot, two side surfaces of each one of the conductive buffers are respectively arranged adjacent to two side surfaces of two of the limiting columns facing with each other.

13. The high-speed connector as claimed in claim 12, wherein when each one of the conductive buffers is pressed to transform from the initial state to the deformation state, each side surface of the corresponding conductive buffer is deformed to extend toward a proximity space.

14. The high-speed connector as claimed in claim 12, wherein a notch is formed on a portion of each limiting column adjacent to the inserting surface, the stopping flanges of the electrical bridge are respectively arranged in the notches and are respectively contacted with the limiting columns.

15. The high-speed connector as claimed in claim 12, wherein the two side surfaces facing each other of any two adjacent limiting columns respectively have cutaways; when each one of the conductive buffers is pressed to transform from the initial state to the deformation state, the side surfaces of the conductive buffers are deformed to respectively extend toward the cutaways.

16. The high-speed connector as claimed in claim 10, wherein the swing segment of each one of the grounding terminals has a connecting portion, a contacting portion, and a free end portion arranged in sequence, wherein the conductive buffers are respectively arranged in the swing paths of the free end portions of the swing segments of the grounding terminals corresponding to the electrical bridge.

17. The high-speed connector as claimed in claim 10, wherein the swing segment of each one of the grounding terminals has a connecting portion, a contacting portion, and a free end portion arranged in sequence, wherein the conductive buffers are respectively arranged in the swing paths of the connecting portions of the swing segments of the grounding terminals corresponding to the electrical bridge.

* * * * *